US007188705B1

(12) United States Patent
Fuhrmann

(10) Patent No.: US 7,188,705 B1
(45) Date of Patent: Mar. 13, 2007

(54) EMERGENCY EVACUATION SYSTEM FOR HIGH-RISE BUILDINGS

(76) Inventor: Kurt F. Fuhrmann, 320 W. Roosevelt St., DeKalb, IL (US) 60115

( * ) Notice: Subject to any disclaimer, the term of this patent is extended or adjusted under 35 U.S.C. 154(b) by 55 days.

(21) Appl. No.: 10/666,429

(22) Filed: Sep. 19, 2003

(51) Int. Cl.
*A62B 1/20* (2006.01)

(52) U.S. Cl. ..... 182/48

(58) Field of Classification Search ..... 182/82, 182/3, 48, 142, 49, 138; 187/277; 193/25 R
See application file for complete search history.

(56) References Cited

U.S. PATENT DOCUMENTS

| | | | | | |
|---|---|---|---|---|---|
| 309,292 | A | | 12/1884 | Clokey | |
| 342,810 | A | | 6/1886 | Putnam | |
| 670,050 | A | | 3/1901 | Hull | |
| 1,029,769 | A | | 8/1912 | Smith | |
| 1,265,165 | A | | 5/1918 | Bartley | |
| 1,596,552 | A | * | 8/1926 | Potter | 182/47 |
| 3,910,377 | A | | 10/1975 | Zamoski | |
| 4,037,685 | A | | 7/1977 | Talucci | |
| 4,162,717 | A | | 7/1979 | Orii | |
| 4,262,772 | A | | 4/1981 | Richardson | |
| 4,398,621 | A | | 8/1983 | Baker | |
| 4,997,060 | A | | 3/1991 | Sassak | |
| 5,060,753 | A | * | 10/1991 | Hopkins | 182/48 |
| 5,115,885 | A | | 5/1992 | Chouest | |
| 5,355,975 | A | | 10/1994 | Laurutis | |
| 5,447,211 | A | | 9/1995 | Sors | |
| 5,583,326 | A | | 12/1996 | Sors | |
| 6,085,873 | A | | 7/2000 | Macchi | |
| 2003/0116380 | A1 | * | 6/2003 | Xia et al. | 182/48 |
| 2004/0245046 | A1 | * | 12/2004 | Du Perron | 182/48 |

FOREIGN PATENT DOCUMENTS

| | | | | |
|---|---|---|---|---|
| DE | 10202245 | * | 1/2002 | 182/82 X |

* cited by examiner

*Primary Examiner*—Hugh B. Thompson, II

(57) ABSTRACT

An evacuation system for high-rise buildings includes an evacuation tube that extends vertically from an entrance on an upper floor to ground level, and a carrier that descends freely through the tube to swiftly carry a person from the upper floor to the ground. A storage tube holds multiple carriers near the entrance to the evacuation tube. The evacuation tube is configured to control the rate of descent of the carrier via established radial clearances and resulting progressively increasing pneumatic pressured-air damping under the carrier, to achieve an initial rapid descent, then a slower descent as the carrier approaches ground lever. Exiting the evacuation tube in the carrier is controlled through large sequenced valves that establish an airlock between the inside of the tube and the outside environment.

25 Claims, 12 Drawing Sheets

EMERGENCY EVACUATION SYSTEM FOR HIGH-RISE BUILDINGS

BACKGROUND OF THE INVENTION

1. Field of Invention

The present invention relates generally to an evacuation system for high-rise buildings.

More particularly, the invention relates to an evacuation system suitable for installation both on the outside of a high-rise building, and internal in the building, which does not rely on electric power for operation, and which is capable of safe, swift evacuation of all persons from upper floors in the building.

2. Description of Prior Art

The art is replete with evacuation systems for multi-story and high-rise buildings. These prior systems take many forms, and range from simple fabric chutes to complicated and expensive, electronically controlled systems.

Fire escapes made from fabric or mesh chutes are disclosed in, for example, Putman U.S. Pat. No. 342,810, Bartley U.S. Pat. No. 1,265,165, Barker U.S. Pat. No. 4,398,621 and Orii et al. U.S. Pat. No. 4,162,717. Such arrangements suffer from several drawbacks and disadvantages in relation to use in a high-rise building. They have limited usefulness in a high-rise building because of the height of the building, and therefore the drop through which a person muse descend. They are not suitable for use on the inside a building because, among other things, the fabric escape chute would be relatively easily damaged, and special provisions such as in Putman would be required to protect the user from the dangers of a fire proximate the chute. They also can not be easily used by an injured or unconscious person, or a handicapped person such as in a wheel chair.

Other escape devices are provided with slides or angled chutes along which a person slides to escape the building. For example, Richardson U.S. Pat. No. 4,262,772 discloses a fire escape in which a person slides down an inclined chute on his or her back, and requires the person to manually show his or her descent by gripping a handrail. Again, the height of many high-rise buildings preclude safe use of such arrangements, and they present the possibility of injury to the user as a result if the sliding action, and in the case of the Richardson arrangement, injury from manually gripping the hand rail. Such arrangements are also not easily used by an injured, unconscious or handicapped people.

Conveyer type escape systems are disclosed in Clokey U.S. Pat. No. 309,929, Hull U.S. Pat. No. 670,050 and Smith U.S. Pat. No. 1,029,769. These devices may sometimes be configured for use by most people, however, there are relatively complicated, and therefore expensive and would be prone to malfunction in the event of an emergency. They also typically rely on the availability of electrical power for proper operation, which power may or may not be available without provision of backup generating equipment.

Elevators are also indicated for use in evacuating a building, such as disclosed in Sassak U.S. Pat. No. 4,997,060 and Laurutis U.S. Pat. No. 5,355,975. However, these arrangements also typically require electric power for successful operation.

There is an ever-present need for an improved system for safe and swift evacuation of a high-rise building. In particular, there is a need for a high-rise building evacuation system that address the above-identified drawbacks and disadvantages of prior building evacuation systems.

SUMMARY OF THE INVENTION

The general aim of the present invention is to provide a new and improved system for safe and swift evacuation of a high-rise building.

Another aim of the invention is to provide an evacuation system suitable for installation either on the outside of or internal to a high-rise building.

A detailed objective is to achieve the foregoing in an evacuation system that is ruggedly built for tolerance to damage from outside forces.

Another objective of the invention is to provide a high-rise building evacuation system that is operable without electric power. This characteristic enables evacuation of the building even in the event of loss of electrical power, without the need for a separate or backup electrical power supply.

Yet another objective of the invention is to provide a high-rise building evacuation system that does not require complicated or expensive control components or logic, and is low cost, simple and reliable in construction and operation.

Still another objective of the invention is to provide a building evacuation system suitable for evacuation of all people, including injured, unconscious and handicapped people.

These and other objectives and advantages of the invention will become more apparent from the following detailed description when taken in conjunction with the accompanying drawings.

An evacuation system in accordance with the invention includes an evacuation tube that extends from an entrance on an upper floor of a building to a landing at ground level, and a carrier that descends through the evacuation tube to carry a person from the upper floor swiftly and safely to the ground. The evacuation system is either installed on the exterior of an existing building or incorporated into the super structure of a new building. The carrier is sized to safely carry an adult. A seat and handle located in the carrier enable the occupant to remain seated as the carrier descends in the evacuation tube. A set of integral annular rings on the outside of the carrier establish controlled clearance with the inside of the evacuation tube. Located on the upper floor near the entrance to the evacuation tube is a storage tube that holds multiple carriers. The carriers are biased in the holder towards a discharge opening. A lip at the discharge opening normally retains the carriers therein, but is provided with a resilient structure to establish discharge operation similar to a conventional paper cup holder.

In the event of an emergency, a person removes a carrier from the holder and places it into the top of the evacuation tube. The empty carrier is maintained at the top of the tube with a resilient lip at the entrance of the tube. The person then climbs into the carrier whereupon weight of the person collapses the lip and the carrier begins its descent in the evacuation tube. The integral rings of the carrier are sized for an initial clearance with the inside of the evacuation tube such that the air escaping around the sides of the carrier will allow the carrier to descend rapidly in the tube. At a lower floor, such as at approximately the 14th story of the building, the evacuation tube will narrow to reduce the clearance. This reduced clearance will slow the escape of air around the carrier and cause air pressure to begin to build under the carrier, as in a pneumatic dashpot, thus slowing the descent of the carrier. At a yet lower floor, approaching ground level, the tube will narrow further, to further reduce the clearance, to or towards approaching engagement between the rings and the tube, and thereby virtually eliminate the clearance between the tube and the carrier. At this point, the descent of the carrier slows substantially due to the increasing pressure below the carrier.

Two large iris-type valves are located proximate the first floor in the lower portion of the tube. The valves are pneumatically and sequentially operated to establish an air-lock between the inside of the evacuation tube and the outside environment through which the carrier passes to reach ground level. The air-lock maintains the increasing pressure in the evacuation tube under each carrier as a carrier below it exits the tube. The carrier passes through the first valve, which is normally open, and triggers a first tripper switch that causes the first valve to close. When the first valve completely closes, an end-of-stroke switch is actuated to cause the second valve to open. As the carrier passes through the second valve, the carrier triggers a second tripper switch that closes the second valve. When the second valve completely closes, a second end-of-stroke switch actuates to cause the first valve to re-open. The iris valves are then in condition ready to repeat the cycle for the next carrier to pass therethrough as the first carrier exits to outside the building.

Figure 2:
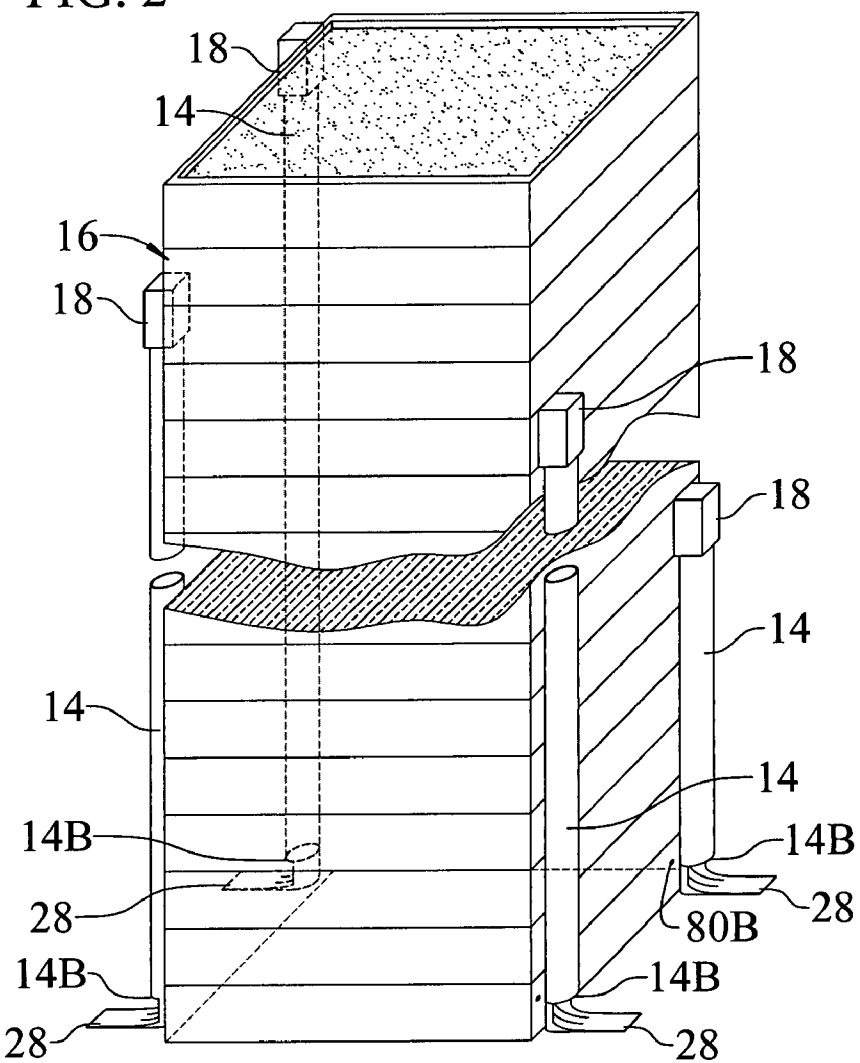
FIG. 2 is a fragmentary perspective view of the high-rise building equipped with an external evacuation system in accordance with the invention.

| | |
|---|---|
| 10 | internal evacuation stations |
| 10A | entry to evacuation station |
| 10B | exit from evacuation station |
| 10C | window at exit |
| 12 | high-rise building with internal evacuation station |
| 14 | external evacuation stations |
| 14A | entry to evacuation station |
| 14B | exit from evacuation station |
| 16 | high-rise building with external evacuation station |
| 18 | external housing structure |
| 20 | evacuation tube |
| 20A | tube entrance |
| 20B | tube exit |
| 20C | glass or plastic lower length of tube |
| 22 | carrier |
| 24 | holder |
| 26 | upper floor |
| 28 | landing |
| 30 | tube framework |
| 32 | holder frame |
| 32A | frame floor element |
| 34 | retaining lip structure |
| 36 | spring |
| 38 | return shutoff valve |
| 40 | upper iris valve |
| 42 | lower iris valve |
| 44 | upper tripper switch |
| 46 | upper end-of-stroke switch |
| 48 | lower tripper switch |
| 50 | lower end-of-stroke switch |
| 52 | electrical powered pneumatic pump |
| 52A | stored pneumatic pressure source |
| 52B | connector for external pneumatic pressure source |
| 54 | pneumatic pressure lines |
| 56 | upper valve cylinder |
| 58 | lower valve cylinder |
| 60 | cover flap |
| 62 | curved ramp |
| 64 | carrier bottom |
| 66 | carrier seat |
| 68 | carrier sides |
| 70 | carrier flange |
| 72 | carrier handle |
| 74 | rings |
| 76 | platform |
| 78 | instructions |
| 80 | voice tube |
| 80A | voice tube ends |
| 82 | retaining lip structure |
| 84 | cushion spring |

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

Figure 1:
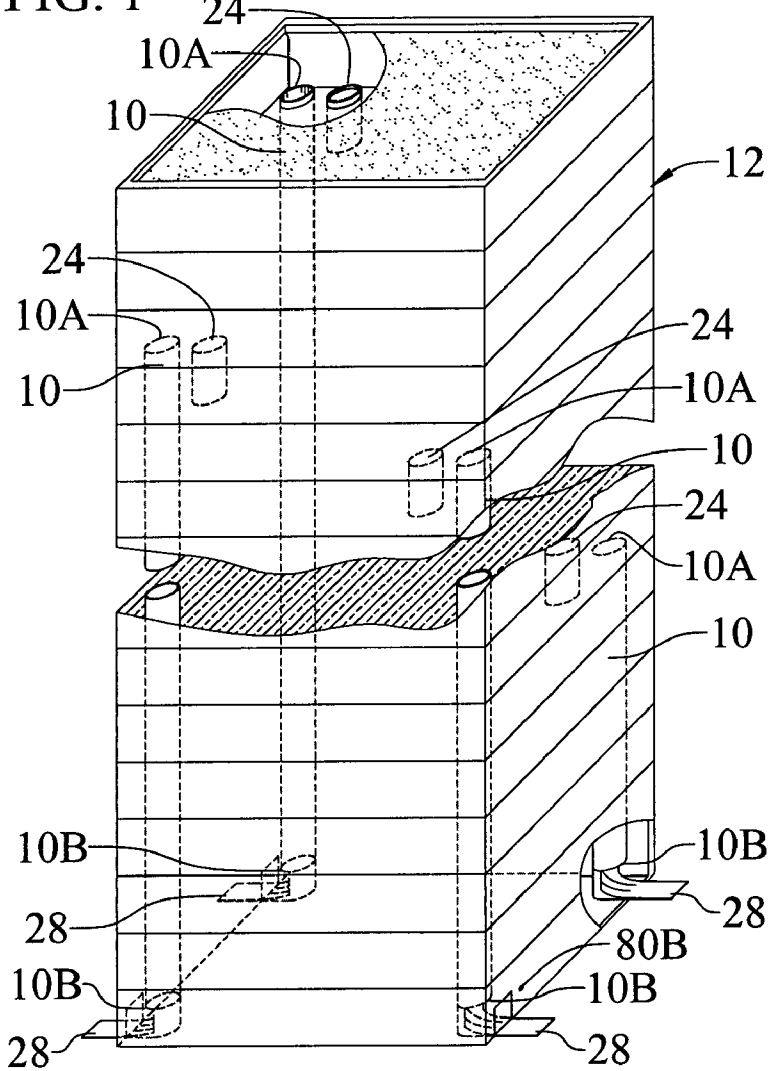
FIG. 1 is a fragmentary perspective view of high-rise building equipped with a new and improved internal evacuation system in accordance with the invention, the system shown comprising four evacuation stations.

The present invention relates to an evacuation system comprising one or more evacuation stations for a high-rise building. An evacuation system in accordance with the invention shown in FIG. 1 includes four evacuation stations 10 as installed internal in a high-rise building 12. Alternately, or in addition, an evacuation system in accordance with the invention may include evacuation stations 14 installed onto the outside of a building such as an existing building 16 shown in FIG. 2. Except as modified with an external housing structure 18 to provide protection of the entrance to the evacuation station from the outside environment, the components, description and operation of the internal evacuation station 10 and the external evacuation station 14 are substantially the same.

The evacuation stations 10, 14 are provided with entry locations 10A, 14A at designated upper floors of the building, and building exit locations 10B, 14B established at ground level. Evacuation stations with entry locations on any floor will be provided as desired. Alternate exit locations may be provided, such as in a parking garage, or at such other convenient location as desired. It will be understood that reference to ground level herein refers to all such convenient exit locations.

Figure 3:
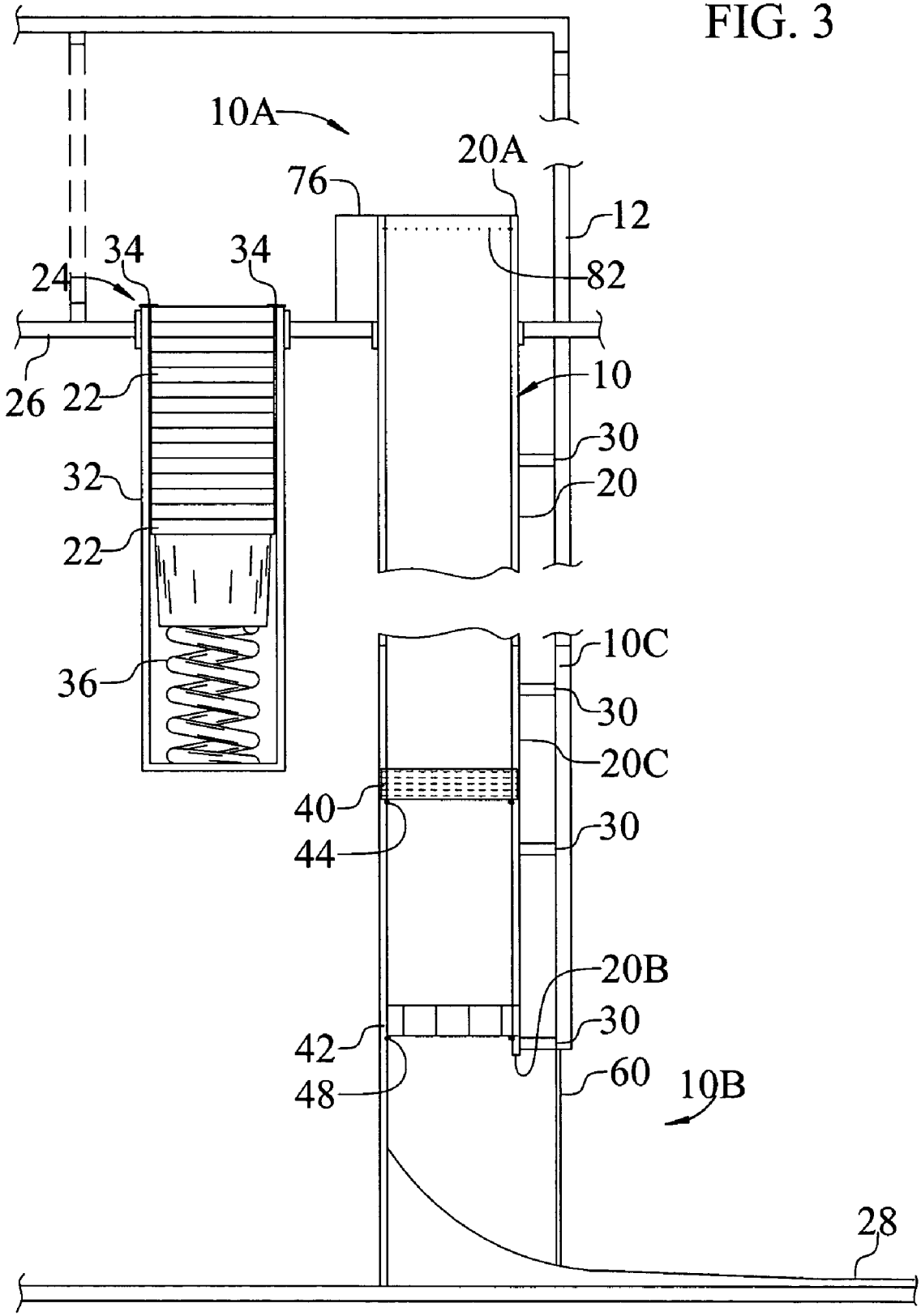
FIG. 3 is a side cross-sectional view of an internal evacuation station shown in FIG. 1.
Figure 4:
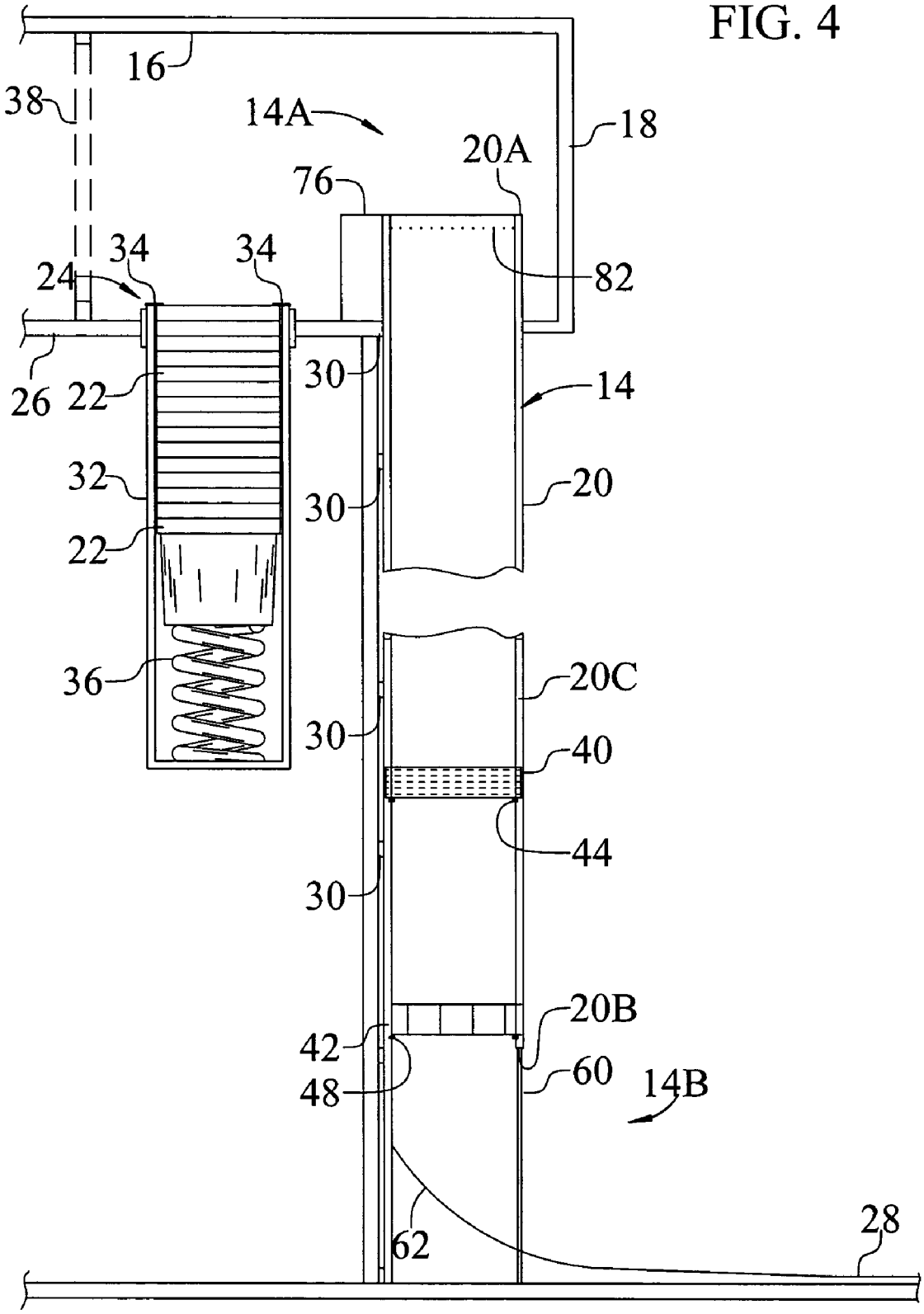
FIG. 4 is a side cross-sectional view of an external evacuation station shown in FIG. 2.

As shown in the detail in FIGS. 3–4, the evacuation stations 10, 14 include a vertical evacuation shaft or tube 20, a portable personnel carrier 22 that carries a person from the upper floor 26 in the building 12, 16 to proximate ground level via pneumatically damped free-fall through the tube, and a holder 24 that holds a supply of carriers. The evacuation tube is installed either incorporated into the super structure of a new building 12 (FIGS. 1 and 3) and/or on the exterior of an existing building 16 (FIGS. 2 and 4). The evacuation tube is configured with an upper end 20A that opens horizontally upwardly at the upper floor for access from the station entry locations 10A, 14A, and a lower end 20B that opens horizontally downwardly for access to the building exit location 10B, 14B at ground level. The evacuation tube extends vertically from the upper open end to the lower open end proximate ground level, and is structurally connected to the building via suitable brackets or framework as indicated at 30 for stable vertical positioning relative to the building. A. The lower end of the evacuation tube opens to a curved exit ramp 62 and a connected landing 28 that provide exit from the building at ground level. The evacuation tube is further provided with a thick-wall, rugged construction to prevent damage to the inside of the tube from anticipated external influences.

The external evacuation station 14 includes the enclosure structure 18 connected or extending to the outside of the building 16, surrounding the upper open end 20A of the external evacuation tube located on the outside of the building. The external housing structure protects the upper open end of the evacuation tube from the outside environment. A door or other access way 38 provides access to the external housing and the entrance to the evacuation tube from inside the building. If desired, a slip-on or other protective cover (not shown) that is easily removed may be provided over the upper open end of the internal evacuation tube, or an internal enclosure structure with a doorway access may be provided surrounding the upper end of the internal evacuation tube, for ease of access to the evacuation tube, but to prevent inadvertent or mischievous access to the tube. A flexible cover or flap 60 is provided to isolate the exit locations 10B, 14B of the evacuation stations from the outside environment.

The carrier holder 24 is located on the same floor 26 as the entry location 20A of the evacuation tube 20. The holder includes a frame 32 that establishes a cavity with an open end sized to slidably receive and releasably carry a stack of carriers 22. The holder frame shown is open at the top, and includes a floor element 32A at the bottom. The frame is connected to the floor 26 of the building, or otherwise connected to the building to present its dispensing opening proximate the floor for ease of removing the carriers from the holder. The carrier holder further includes a biasing mechanism, shown in the form of spring 36, that biases carriers in the holder upwardly towards the opening of the holder, and a retaining lip structure 34 at the holder opening. The retaining lip are thin elements provided around the opening that resiliently gives way for insertion of the carriers into the holder and for one-at-a-time removal of a carrier from the holder, but that retains the carriers in the holder against the force of the biasing mechanism. Thus, the carrier holder establishes operational carrier receipt and dispensing characteristics similar to a common paper cup holder. The carrier holder is preferably located proximate the evacuation tube 20 to insure the ready availability of the carriers in the event of an emergency that suggests prompt evacuation of the building. Alternately, for example, the holder is provided in a portable, stowable form such as on rollers, or is secured in an overhead position, with its opening facing downwardly proximate the entrance to the evacuation tube.

The internal configuration of the evacuation tube 20 and the external configuration of the carrier 22 are provided in a complimentary manner to enable the carrier to descend in controller, pneumatic damped free-fall through the tube, to quickly and safely evacuate people from the upper floors of the building. Accordingly, the internal profile of the evacuation tube is characterized as free from inwardly protruding structure that would preclude the pneumatically damped free-fall of the carrier in the tube. In the preferred embodiment show, the tube 20 is provided with a smooth, cylindrical internal structure from the open upper end 20A to the open lower end 20B, and the carrier 22 is provided with a smooth, cylindrical outer structure sized for complimentary operation with the tube as discussed below.

Figure 5:
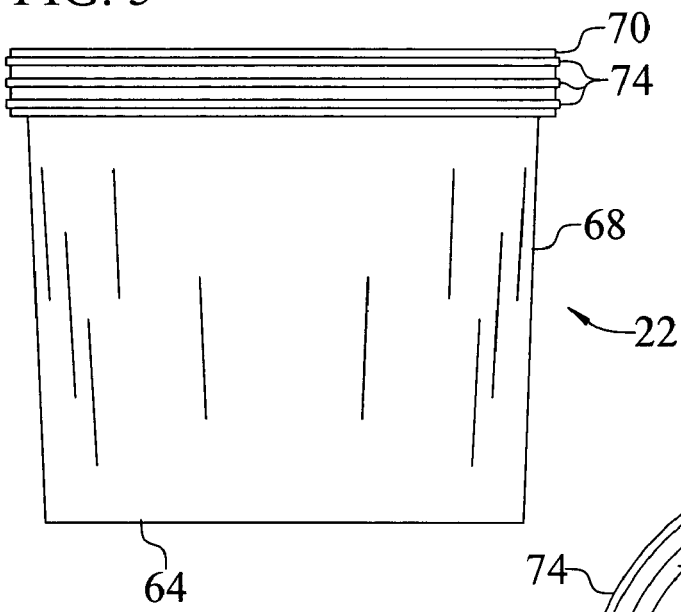
FIG. 5 is an enlarged side view of a personnel carrier shown in FIGS. 3 and 4.
Figure 6:
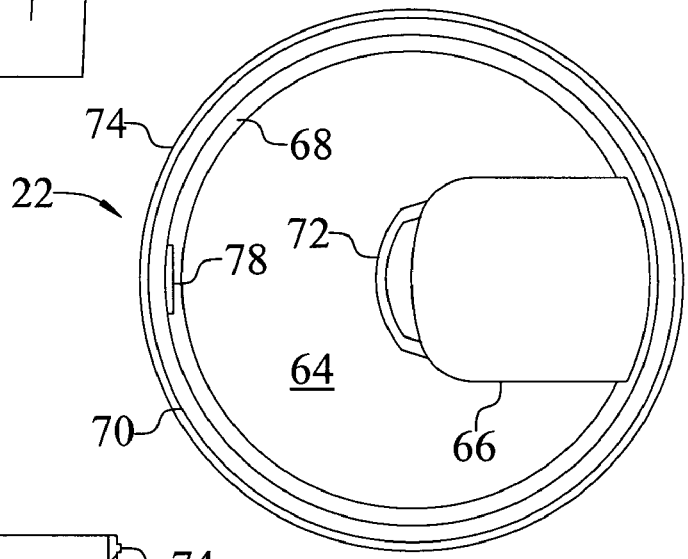
FIG. 6 is a top plan view of the carrier.
Figure 7:
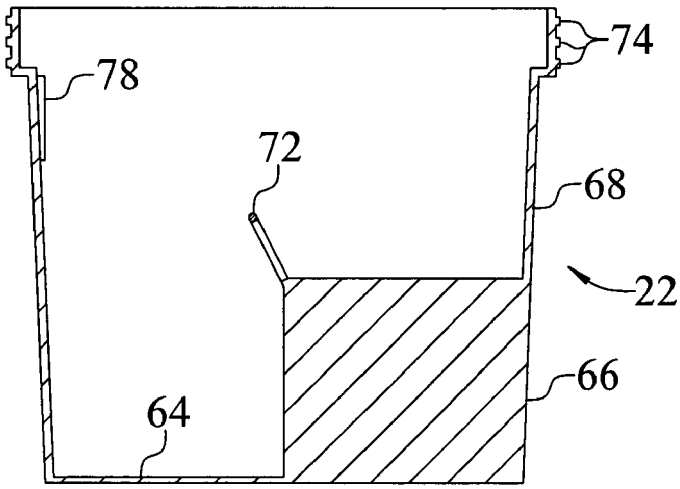
FIG. 7 is a side cross-sectional view of the carrier.

The carrier 22 shown in detail in FIGS. 5–7 is generally cup-shaped, and is structurally designed and sized, such as approximately 36 inches diameter, to safely carry an adult down the evacuation tube 20. The carrier includes a closed bottom 64, a seat 66 secured to or integrally formed with the bottom, sidewalls 68 that extend upwardly and outwardly from the bottom to established a closed carrier structure from below, a surrounding flange 70 at the top of the sidewalls, and a handle 72 secured to either the seat or to the sidewall forward of the seat. The outwardly tapered configuration of the sides enables stacking of carriers when not in use. A set of instructions 78 for safe use of the carrier is included on the inside of the front wall forwarded of the seat. The flange 70 is provided with a set of rings 74 that are preferably integrally formed in the flange to prevent the possibility of removal therefrom and thereby rendering the carrier inoperable as provided for herein. The size and spacing of the rings are established to provide clearance with the inside diameter of the evacuation tube as discussed further below, and are configured to prevent the carrier from tilting and locking up in the evacuation tube, and prevent the bottom of the carrier from engaging the side of the evacuation tube, as the carrier descends through the tube.

In general, the largest outside profile of the carrier 22 and the inside profile of the evacuation tube 20 are sized for a relatively close clearance fit to enable the carrier to descend freely, but pneumatically damped, down the tube. In the embodiment show, the outside diameter of the carrier flange 70 and the inside diameter of the evacuation tube are sized for a close clearance fit at the upper portion of the tube. The inside diameter of the tube is further configured to automatically, pneumatically slow or brake the descent of the carrier as it approaches ground level. In carrying out this aspect of the invention, the radial clearance between the outside diameter of the rings 74, and the inside diameter of the evacuation tube is established at, for example, approximately ¼ inch at the top of the tube to allow substantially free fall of the carrier in the tube. Part way down the tube, this radial clearance reduces to, for example, approximately 1/16 inch to build air pressure below the carrier and slow the carrier in its descent. Further down the evacuation tube, the diameter of the tube reduces again, to further reduce the clearance between the OD of the rings and the ID of the tube, to an extremely small clearance that approaches zero clearance, and thereby approaches engagement between the rings and the inside diameter of the evacuation tube. This results in building of additional positive air pressure below the carrier, to further slow the carrier descent, as it approaches ground level. As a result, the carrier descends rapidly from the top of the tube, and then pneumatically slows as it approaches the center and lower levels of the building. An advantage of multiple guide rings 74, as compared with one guide ring, is to improve the close-fit and resulting air pressure buildup under the descending carrier.

Figure 12:
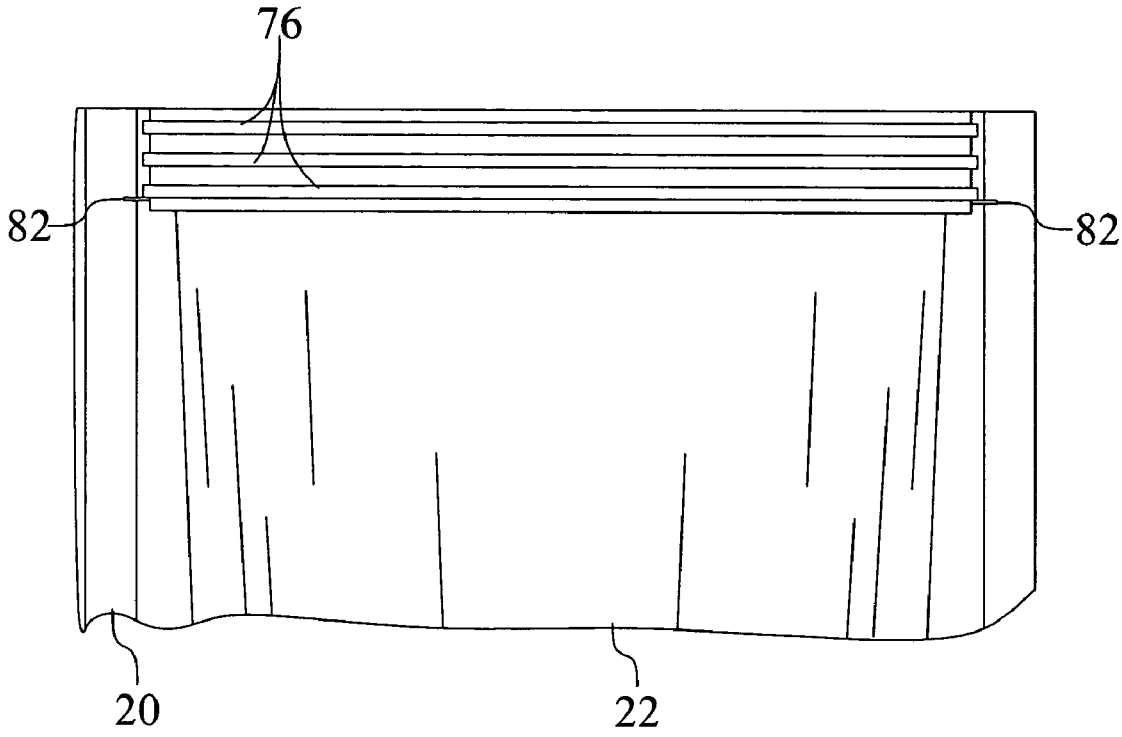
FIG. 12 is an enlarged fragmentary view showing details of the carrier supported in its initial position in the tube.

A mechanism such as a resilient retaining lip structure 82 is provided to temporarily hold a carrier 22 in the top of the evacuation tube 20. The retaining lip structure shown in detail in FIG. 12 is provided as angularly spaced thin resilient elements that project radially inwardly into the tube, that retain the weight of the carrier in the tube, and that resiliently bend downwardly when the weight acting thereon reaches a pre-established weight such as 70 pounds. As a result, the retaining lip structure holds the carrier in position in the top of the evacuation tube as a person climbs into the carrier, and then give way for the carrier to descend through the tube.

Figure 8A:
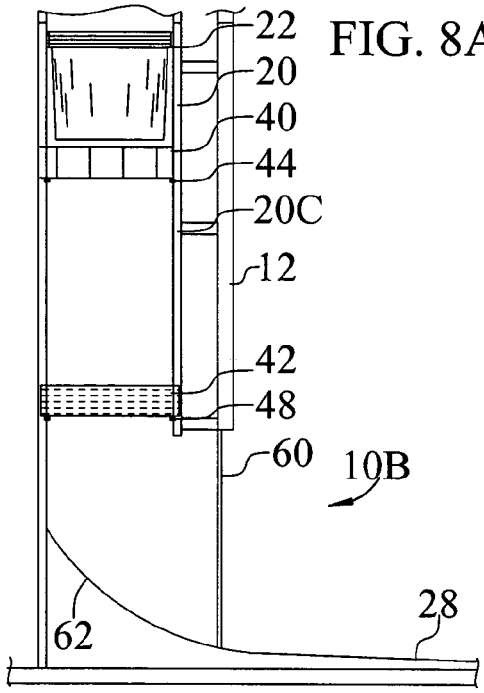
FIGS. 8A–G are side cross-sectional views of the lower portion of the evacuation station, showing consecutive positions of a personnel carrier and control valves operative to establish an airlock near the exit location of the station.
Figure 8B:
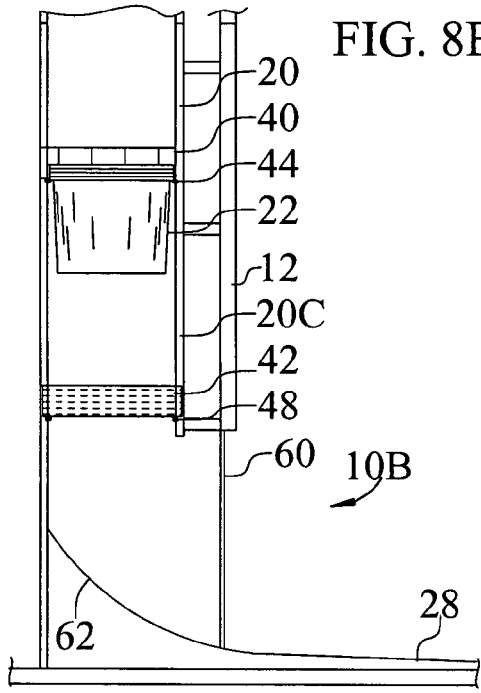
Figure 8C:
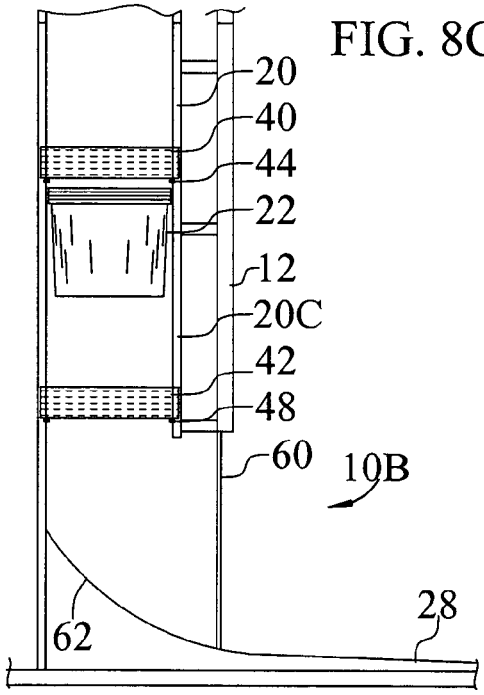
Figure 8D:
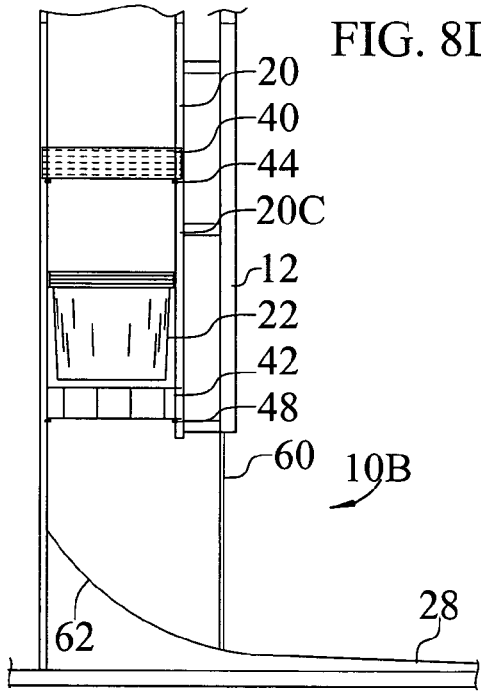
Figure 8E:
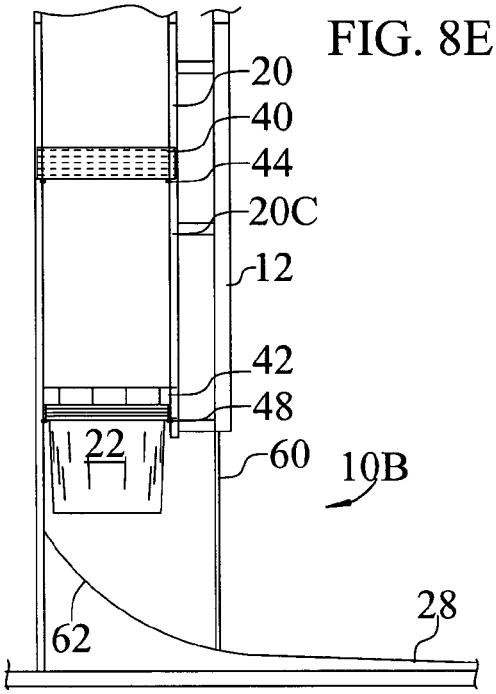
Figure 8F:
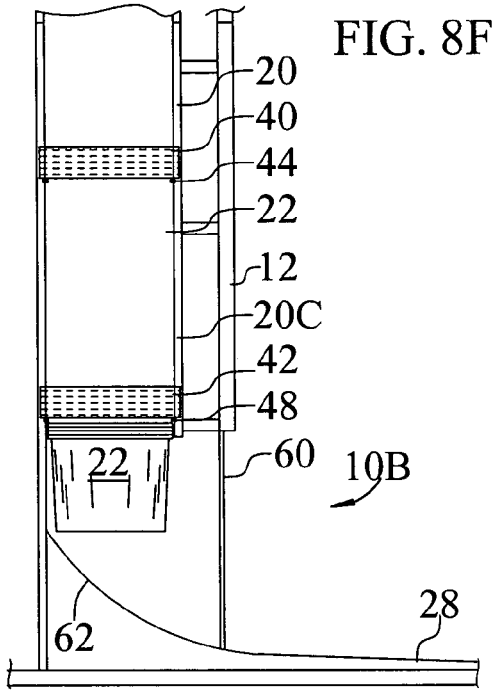
Figure 8G:
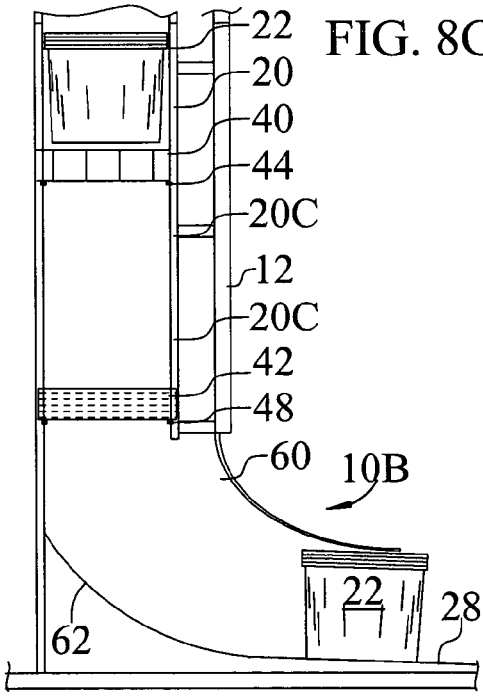

Located in the lower portion of the evacuation tube 20 is an air-lock between the inside of the evacuation tube and the outside environment, and through which the carrier 22 passes as it approaches ground level. In the embodiment shown, upper and lower iris-type valves 40 and 42 are located at approximately the first floor lever in the evacuation tube, and are pneumatically and sequentially operated to establish the air-lock. Sequential operation of the iris valves is illustrated in FIGS. 8A–G. Initially, and as shown in FIG. 8A, as a carrier approaches, the upper iris valve 40 is open and the lower iris valve 42 is closed. As the carrier passes through the upper iris valve (FIG. 8B), the carrier engages an upper tripper switch 44 which, when fully tripped by the complete passing of the carrier (FIG. 8C) causes the upper iris valve to close. Upon completion of closing of the upper iris valve, it actuates an end-of-stroke switch 46 (see FIG. 10 and associated discussion below) which causes the lower iris valve to open (FIG. 8D). The carrier then engages (FIG. 8E) and passes completely by (FIG. 8F) a second tripper switch 48 which causes the lower iris valve to close. Upon closing of the lower iris valve, it actuates a second end-of-stroke switch 50 with causes the upper iris valve to open (FIG. 8G) ready to repeat the air-lock sequencing cycle for the next carrier, while the first carrier slides down the curved ramp 62 at the base of the evacuation tube, past the fabric, plastic or other flexible flap 60 at the base of the tube, and out of the building onto the landing 28. This cycle repeats for each carrier that passes through the lower length of the evacuation tube. Thus, the airlock established by the iris valves operate to maintain the positive pressure under each carrier as it approaches the bottom of the tube.

Figure 14:
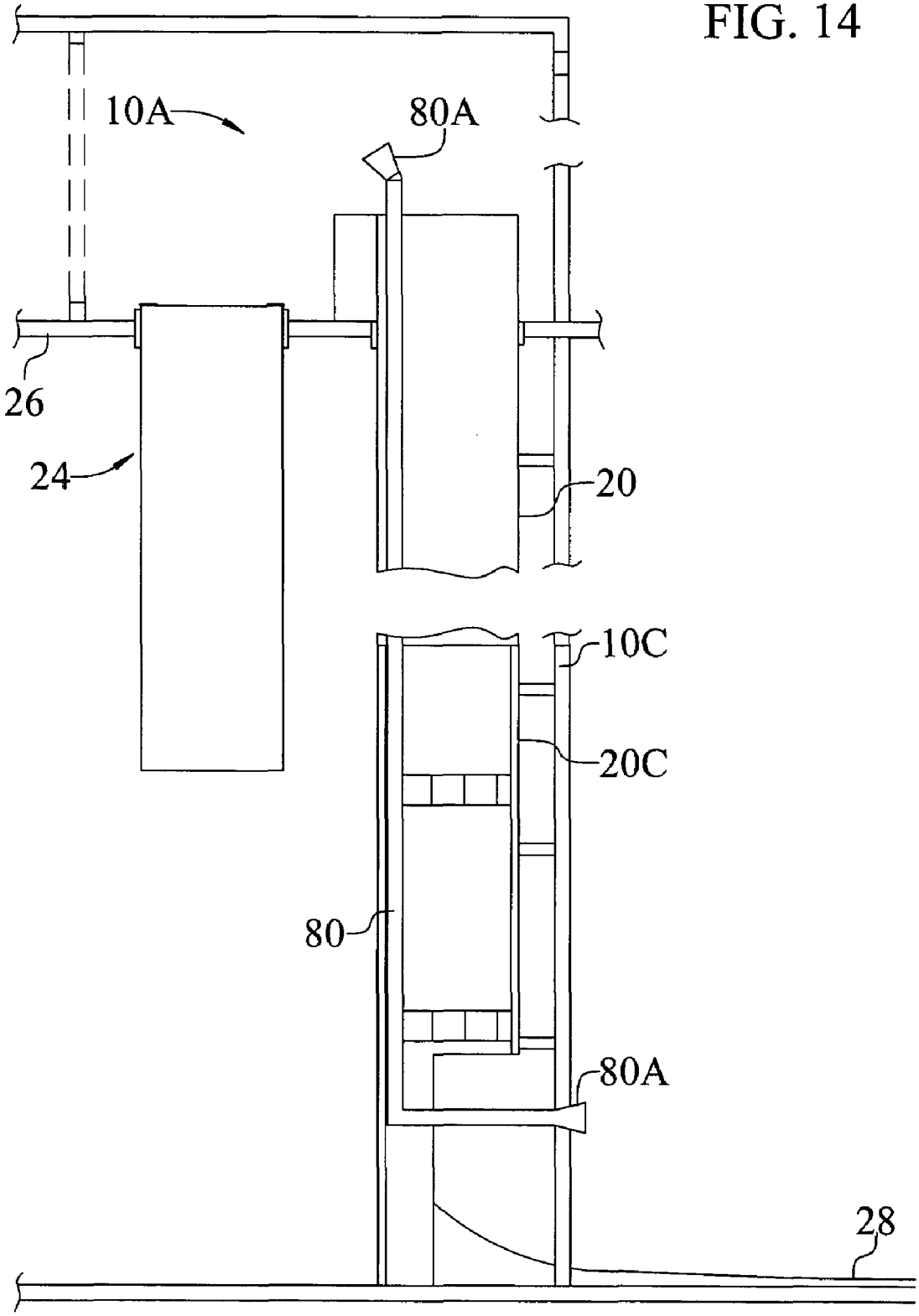
FIG. 14 is a side view of the internal evacuation station and illustrating certain additional components thereof.

A voice tube 80 extends between the upper floor and ground level such as shown in FIG. 14. The voice tube is provided with open ends 80A for communication between the upper floor and ground level, to insure the availability of communication even in the event of loss electrical power or other electronic means for communication.

The lower portion 20C of the tube 20, from the exit 20B up to past the iris valves 40, 42, is made from thick wall glass or plastic. For the evacuation station 10 located inside the building 12, the lower portion of the building corresponding to the height of the lower portion 20C if the tube is also provided with a window 10C. This see-through portion of the tube and building enables ground personnel to visually monitor the status of carriers as they descend through the air-lock and last leg of the tube. With the voice tube, the ground personnel can provide people at the entrance of the tube on the upper floor with status reports such as confirmation of all-clear to proceed with evacuation or warnings as to trouble at the base of the tube.

Figure 9:
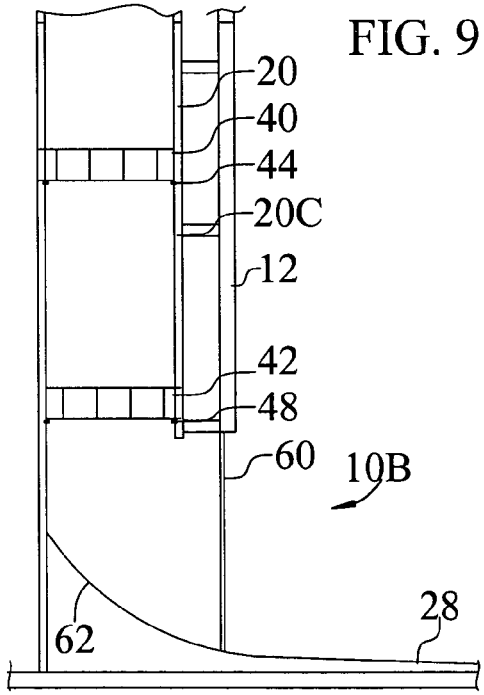
FIG. 9 is a side cross-sectional view showing the control valves in their failure-mode opened conditions.

As illustrated in FIG. 9, both iris valves 4, 42 are configured to fail in the full open position in the event of total loss of pneumatic power. Although the slowing of carriers at the base of the tube, and associated safety in operation, will be compromised with both iris valves open, due to the inability of pressure to building under the descending carrier, a complete failure in the system will not prevent people from evacuating the building in the event of a dire emergency.

Figure 10:
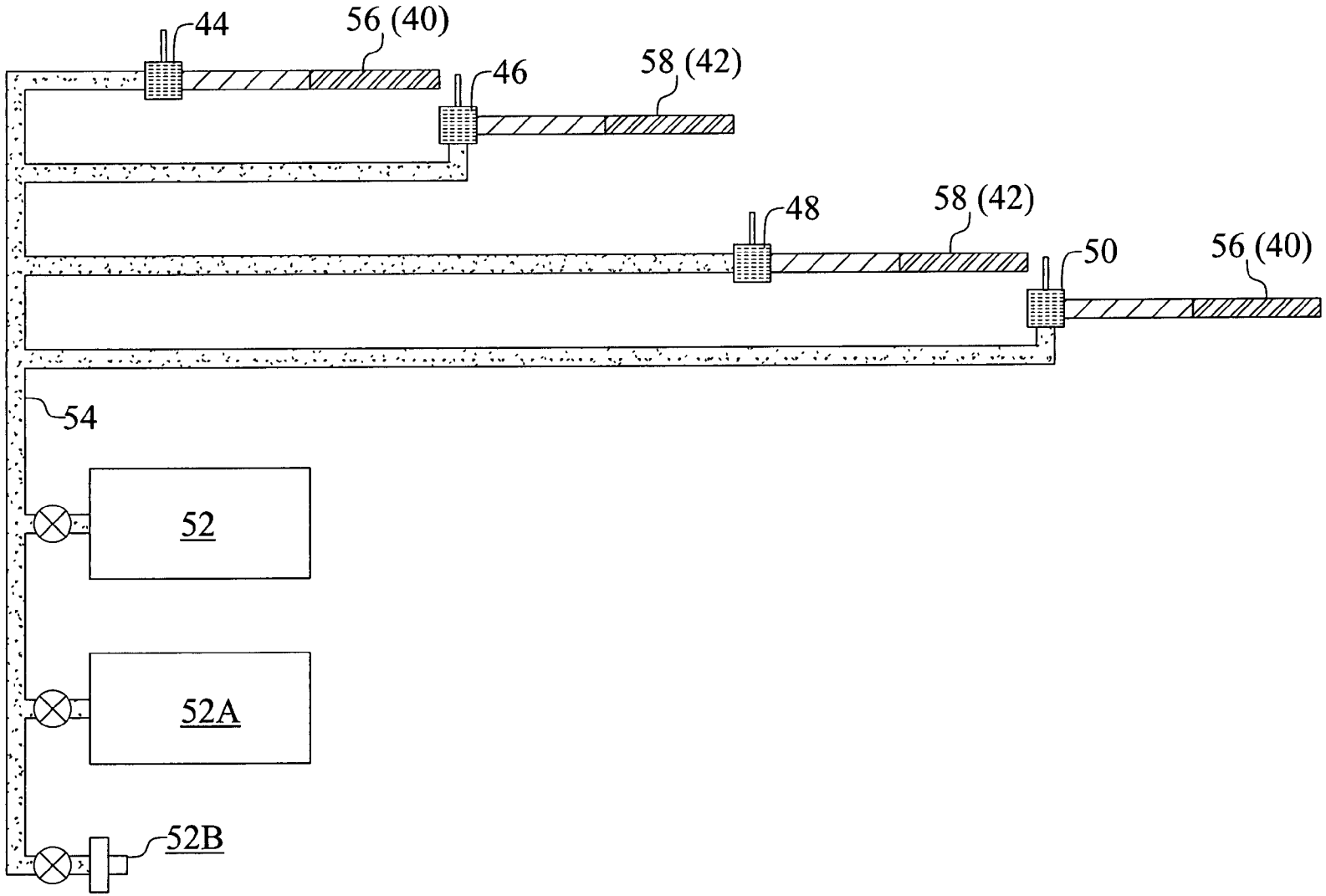
FIG. 10 is a schematic representation of the sequencing and operation of the control valves and certain related operational components.

Further illustration of the sequential operation of the iris valves and associated components that establish the airlock at the base of evacuation tube is shown in FIG. 10. Air pressure is supplied from a source 52 through pneumatic pressure lines 54 to the tripper switches 44 and 48, to the end-of-stroke switches 46 and 50, and to pneumatic cylinders 56 and 58 that power the iris valves 40 and 42 between open and closed positions. As pressure is supplied to the iris valves and associated components, the upper iris valve remains open, and the lower iris valve is automatically closed. Upon actuation of the upper tripper switch 44, the upper iris valve 40 is pneumatically actuated to the closed position by the first cylinder 56. Upon reaching the upper iris valve reaching its full-closed position, cylinder 56 triggers the first end-of-stroke switch 46 which actuates second cylinder 58 to open the lower iris valve 42. Actuation of the second tripper switch 48 as the carrier drops past the lower iris valve actuates cylinder 58 to close the lower iris valve, and upon full closing, triggers the second end-of-stroke switch 50 to actuate cylinder 56 and open the upper iris valve. The sequencing switches are preferably pneumatically or mechanically operated by the movement of the carrier and the associated cylinders, and therefore free of the need for electrical power.

Figure 11:
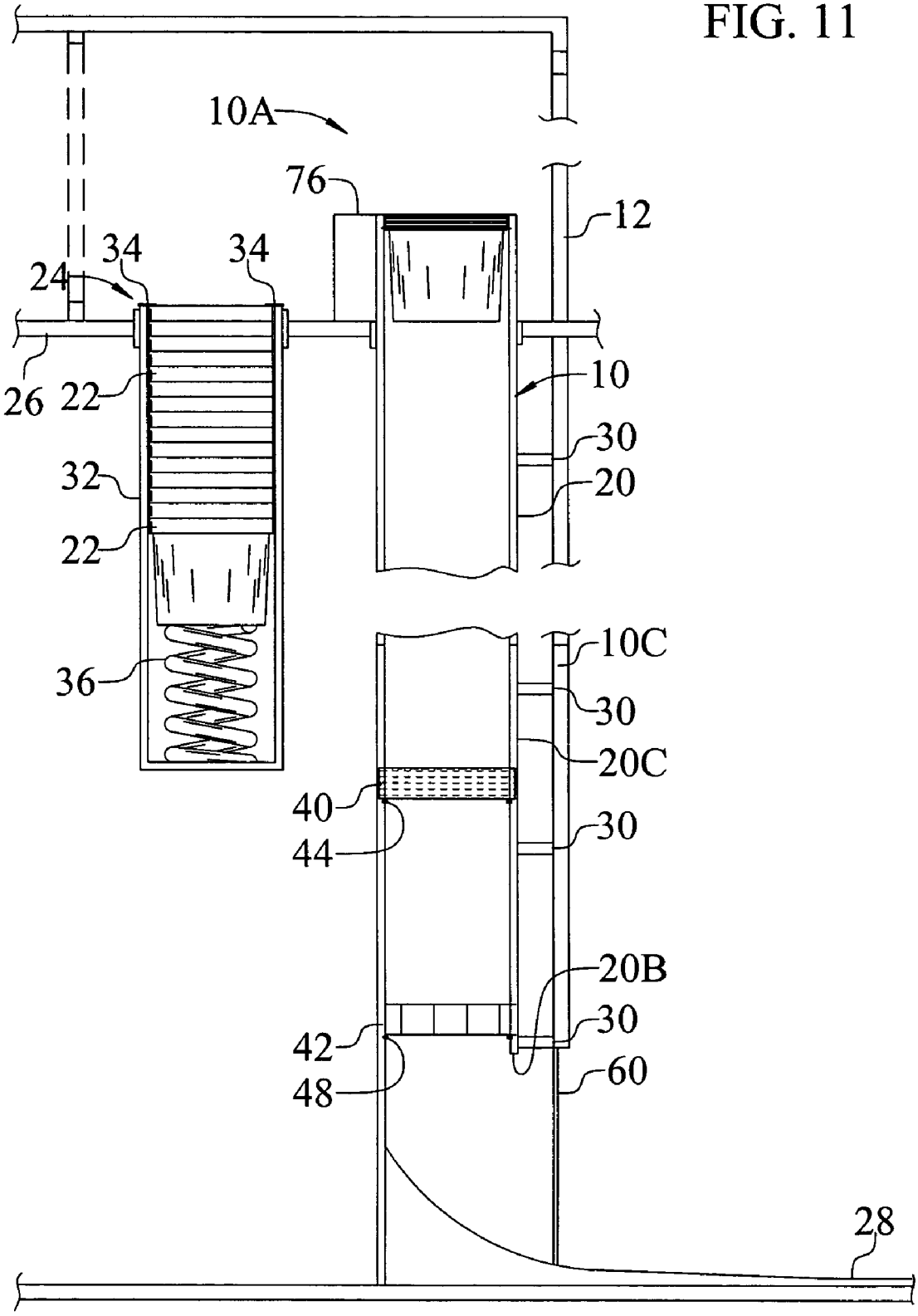
FIG. 11 is a view similar to FIG. 3 showing a carrier as initially positioned into the evacuation tube.

In the event of a need to evacuate the building by a route other then normal exit elevators or stairs, an occupant of the building goes to the evacuation station 10, removes a carrier 22 from the holder 24 and places it as shown in FIG. 11 into the top of the evacuation tube 20. The person then sits onto a seat or platform 76 provided next to the side of the tube, swings his or her feet over the sides of the carrier, and slides downwardly onto the seat in the carrier whereupon the combined weight of the person and carrier causes the carrier to immediately begin its descend in the evacuation tube. Entry of an injured or handicapped person, such as may be assisted or placed into the carrier by someone else in the building, will similarly cause the carrier to begin its descent in the tube. The initial (e.g. 1/4 inch radial) clearance between the carrier rings and the inside wall of the tube will allow air to escape around the sides of the carrier, resulting in an initial rapid descent. At, for example, approximately the 14th floor, the evacuation tube narrows (e.g., to 1/16 inch radial clearance) to slow the escape of air around the carrier and cause air pressure to build under the carrier. As a pneumatic dashpot, this building air pressure begins to slow the descent of the carrier in the tube. Then, at about the $4^{th}$ to $2^{nd}$ story, the tube will narrow further, causing the rings to engage or approach engagement (e.g., 1.64 inch clearance) with the inside of the tube, resulting in a rapid additional building of air pressure below the carrier and an associated rapid slowing of the descending carrier. The carrier then passes through the first normally open iris valve 40, and triggers the first tripper switch 44 to close the first iris valve 40. The second iris valve then opens as described above, the carrier passes safely out of the building, and the cycle begins again for the next approaching carrier.

As previously noted, the preferred evacuation system is capable of operating solely on pneumatic pressure. This permits storage of a ready of supply of pneumatic power for use in any emergency, and eliminates the dependency upon electrical power of many prior building evacuation systems. If desired, an electrical powered pneumatic pump 52A (FIG. 10) may be provided for normal operation of the evacuation system, along with a stored source 52 of pneumatic pressure for operation of the system in the event of loss of electrical power. As further backup, to insure available operation, the evacuation system also includes a connector location 52B for connection of an external pressure source, such as may be provided in a mobile trailer brought to the building by a rescue crew. In keeping with the safety characteristics of the invention, the evacuation system would be normally subject to periodic inspections to insure proper operation at a time when evacuation of the building is required.

Figure 13:
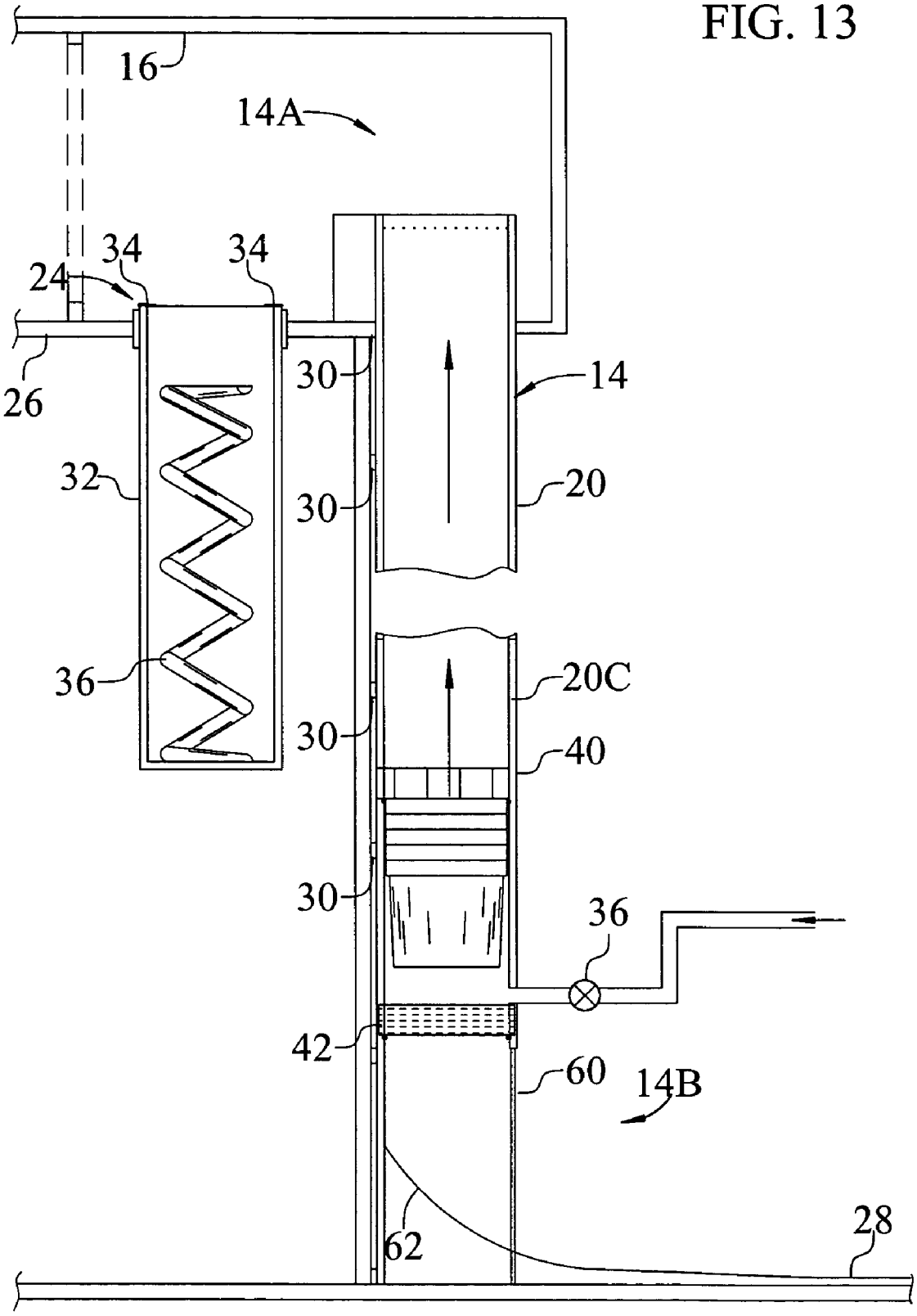
FIG. 13 is a side cross-sectional view showing return of carriers up the evacuation tube.

The pneumatic power source 52, 52A, 52B of the evacuation system 10 may be optionally provided with sufficient capacity to return empty carriers up the evacuation tube to the upper floor 26. In this instance, as shown in FIG. 13, the carriers are manually positioned above the lower iris valve 42, the valve 42 is closed, and the supply valve 64 is opened to pressurize the evacuation tube below the carriers and return the carriers to the inlet 10A of the evacuation tube at the upper floor 26. The returned carriers are then available for use by additional occupants of the building, or to be stowed in the holder in anticipation of the next possible emergency. If desired, to reduce the flow capacity required to return the carriers, a temporary oversized sealing ring is provided in an additional groove in the carrier to establish a seal along the entire length of the evacuation tube. This seal ring is then removed from the carrier prior to reuse or storage in the holder.

Figure 15A:
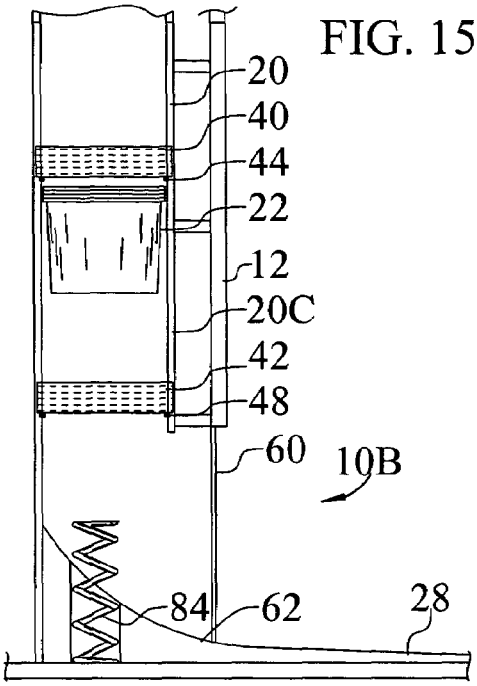
FIGS. 15A–D are side cross-sectional views of the lower portion of an alternate evacuation station, showing consecutive positions of a personnel carrier, control valves operative to establish an airlock, and a cushion spring near the exit location of the station The reference numerals in the drawings correspond to the following items discussed below.
Figure 15B:
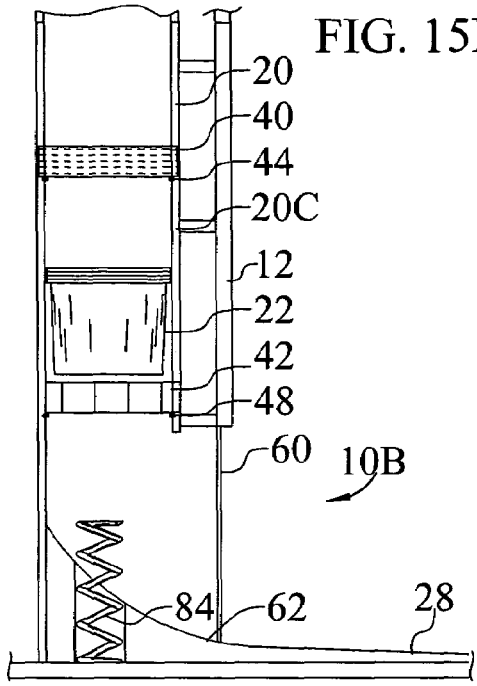
Figure 15C:
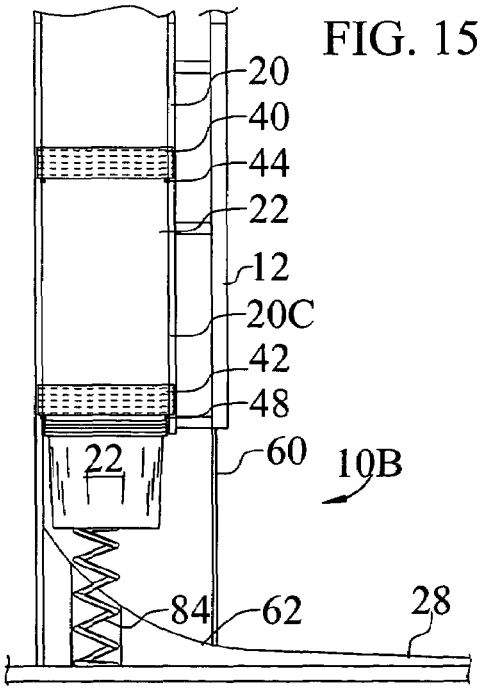
Figure 15D:
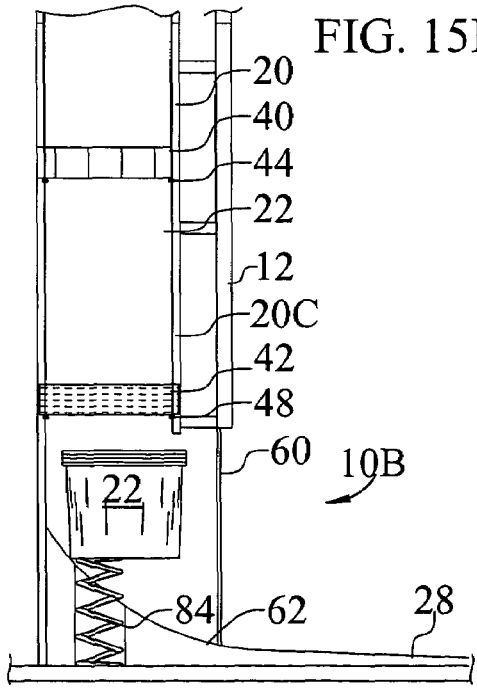

In an embodiment shown in FIGS. 15A–D, the evacuation station include a spring 84 located at the base of the evacuation tube 20. The spring extends upwardly through the upper portion of the exit ramp 62 and is configured to temporarily slow the carrier 22 as it drops past the second open iris valve 42 in the tube. As shown in the drawings, the cushion spring 84 engages the bottom of the carrier (FIG. 15C) as it drops below the second iris valve, resiliently gives way and simultaneously slows and cushions the carrier as it engages and slides down the ramp 62 (FIG. 15D), and then returns to engage and slow the next carrier (FIGS. 15A–B).

Those skilled in the art will understand from the description herein that additional alternate embodiments and additional apparatus may be provided in an evacuation system in accordance with the invention. For example, a battery powered go—no go device may be provided with a light at the upper floor and a switch at ground lever. The switch would be operable by emergency rescue personnel, and the battery would be subject to periodic inspections along with conventional battery operated emergency exit lighting in the building. As another example, in an alternate embodiment (not shown), the integral guide rings 74 are replaced with expandable and contractable guide rings (annular rings with a small angular gap) located in annular grooves in the flange. An advantage of using expandable guide rings is to insure a sliding contact seal in the lower portion of the tube. Alternately, a disadvantage to such non-integral rings is the potential that the rings will twist or otherwise malfunction as the carrier descends in the tube, or be missing from the carrier at a time when the building is to be evacuated. Alternate apparatus may also be provided in place of a spring to cushion the carrier as it drops from the air-lock onto the exit ramp, or the exit ramp may be alternately configured to provide a smooth transition from vertical dropping of the carrier as it exits the building. These and additional alternate embodiments of the invention will be readily devised by the skilled artisan.

From the foregoing, it will be apparent that the present invention brings to the art a new and improved high-rise emergency evacuation system that is uniquely adapted for safe, swift evacuation of the building, without the need for electric power, and that all persons in the building can safely use.

I claim:

1. A system for evacuation of an upper floor of a high-rise building, the evacuation system comprising:

a) a portable carrier adapted to be located at the upper floor of the building; the carrier generally cup-shaped with a closed bottom, surrounding closed sides extending upwardly from the bottom and terminating in an upper surrounding flange, and a guide ring extending radially outwardly from the flange for guiding radially outwardly thereof; the carrier being sized to accommodate an adult therein;

b) a stationary landing ramp exiting to the outside environment at ground level, c) a stationary evacuation tube extending vertically upwardly from the landing ramp; the tube having an open upper entrance end adapted to be located at the upper floor and an open lower exit end communicating with the landing ramp; the inside profile of an upper portion of the tube being configured for mechanically unrestricted pneumatically damped free-fall of the carrier in the tube, and the inside profile of a lower portion of the evacuation tube approaching the size of the guide ring for approaching zero clearance therebetween, whereby the speed of the carrier reduces as a result of pneumatic damping as it descends in the tube; and d) upper and lower valves spanning across the lower end of the evacuation tube proximately above the landing ramp, the valves being automatically operated sequentially between open and closed positions to establish an airlock between the inside of the evacuation tube and the outside environment as the carrier passes therethrough.

2. The evacuation system as defined in claim 1 in which the valves are pneumatically operated free of electrical power requirements.

3. The evacuation system as defined in claim 1 in which the inside profile of the upper portion of the evacuation tube is configured for a first clearance fit with the guide ring in the carrier, the inside profile of the center portion of the evacuation tube is configured for a second clearance fit with the guide ring less that the first clearance fit, and the inside profile of the lower portion of the evacuation tube is configured for a third clearance fit with the guide ring less that the second clearance fit, whereby the inside profile of the tube is configured for progressively increasing pneumatically-damped free fall such that the speed of the descending carrier reduces from pneumatic damping as it passes from the upper to the center portion of the evacuation tube and again as the carrier passes from the center to the lower portion of the evacuation tube.

4. The evacuation system as defined in claim 1 in which the evacuation tube is of thick-wall metal construction for resistance to damage from outside influences, and the lower portion of the evacuation tube as established between the upper valve and the lower exit end of the tube is formed from translucent material for visually monitoring the status of carriers in the lower portion of the tube.

5. The evacuation system as defined in claim 1 in which the carrier and the evacuation tube are formed with complimentary cylindrical construction.

6. The evacuation system as defined in claim 1 in which the evacuation tube is adapted to be secured to the outside of the building, the system further comprising a housing connectable to the outside of the building and surrounding the open upper entrance end of the evacuation tube from the outside environment.

7. The evacuation system as defined in claim 1 in which the carrier further includes a fixed seat and a handle for assistance in securing the user's position in the carrier during descent of the carrier through the evacuation tube.

8. The evacuation system as defined in claim 1 in which the landing ramp curves downwardly from the lower exit end of the tube to ground level.

9. The evacuation system as defined in claim 1 further comprising a retaining lip structure operative for resilient movement between a first position holding the carrier aligned with the center axis of the evacuation tube, and a second position releasing the carrier into the upper open end of the evacuation tube for said pneumatically damped free-fall through the tube.

10. The evacuation system as defined in claim 9 further comprising a seat proximate the upper entrance end of the tube to assist a user in entering the carrier when held in said position aligned with the center axis of the evacuation tube.

11. The evacuation system as defined in claim 1 further comprising a carrier holder adapted to be located at the upper floor of the building, the carrier holder having a frame with upper and lower ends and a cavity therebetween sized to hold a stack of carriers, one of said frame ends having an opening communicating with the cavity and sized to slidably receive said stack of carriers and through which the carriers can be removed, means for biasing the stack of carriers towards said opening in said one frame end, and a resilient lip at said opening configured to normally retain the carriers in the holder against said biasing means and past which each carrier may pass as it is removed from the holder.

12. The evacuation system as defined in claim 1 further comprising upper and lower tripper switches associated with the upper and lower valves, the upper and lower tripper switches being operative to detect the passing of a carrier through the upper and lower valves, respectively, when said valves are in said open positions, the upper and lower tripper switches being further operative to cause said upper and lower valves to close upon detection of the passing of a carrier therethrough, the system further comprising first and second end-of-stroke switches operative to detect full closing of the upper and lower valves, respectively, and to cause opening of the lower and upper valves upon detection of full closing of the upper and lower valves, respectively.

13. The evacuation system as defined in claim 1 further comprising a voice tube adapted to extend from the upper floor of the building to ground level proximate the evacuation tube for non-powered communication between the upper floor and the ground.

14. The evacuation system as defined in claim 1 in which the guide ring is integral with the upper flange of the carrier.

15. A system for evacuation of an upper floor of a high-rise building, the evacuation system comprising:

a) a portable carrier adapted to be located at the upper floor of the building; the carrier generally cup-shaped with a closed bottom, surrounding closed sides extending upwardly from the bottom and terminating in an upper surrounding flange; the carrier having a generally cylindrical outermost profile and having an inner configuration sized to accommodate an adult therein;

b) a stationary landing ramp exiting to the outside environment at ground level, c) a stationary cylindrical evacuation tube extending vertically upwardly from the landing ramp; the tube having an open upper entrance end adapted to be located at the upper floor and an open lower exit end communicating with the landing ramp; an outside diameter of the outermost profile of the carrier and an inside diameter of the evacuation tube being configured for mechanically unrestricted progressively increasing pneumatically damped free-fall of the carrier in the tube whereby the speed of the carrier reduces as a result of increasing pneumatic damping as it descends in the tube; and d) an air-lock mechanism located in an inside lower end of the evacuation tube to establish an airlock between the inside of the evacuation tube and the outside environment, the air-lock mechanism being automatically operated to maintain said airlock as the carrier approaches and passes therethrough to the landing ramp and outside environment.

16. The evacuation system as defined in claim 15 in which the inside diameter of the upper portion of the evacuation tube is configured for a first clearance fit with said outside diameter of the carrier, the inside diameter of the center portion of the evacuation tube is configured for a second clearance fit with said outside diameter of the carrier less that the first clearance fit, and the inside diameter of the lower portion of the evacuation tube is configured for a third clearance fit with said outside diameter of the carrier less that the second clearance fit, whereby the inside diameter of the tube is configured such that the speed of the descending carrier reduces from increasing pneumatic damping as it passes from the upper to the center portion of the evacuation tube and again as the carrier passes from the center to the lower portion of the evacuation tube.

17. The evacuation system as defined in claim 15 in which the evacuation tube is of thick-wall metal construction for resistance to damage from outside influences, and the lower portion of the evacuation tube as established between the position of the airlock mechanism and the lower exit end of the tube is formed from translucent material for visually monitoring the status of carriers in the lower portion of the tube.

18. The evacuation system as defined in claim 15 in which the evacuation tube is adapted to be secured to the outside of the building, the system further comprising a housing connectable to the outside of the building and surrounding the open upper entrance end of the evacuation tube from the outside environment.

19. The evacuation system as defined in claim 15 in which the carrier further includes a fixed seat and a handle for assistance in securing the user's position in the carrier during descent of the carrier through the evacuation tube.

20. The evacuation system as defined in claim 15 in which the landing ramp curves downwardly from the lower exit end of the tube to ground level.

21. The evacuation system as defined in claim 15 further comprising a retaining lip structure operative for resilient movement between a first position holding the carrier aligned with the center axis of the evacuation tube, and a second position releasing the carrier into the upper open end of the evacuation tube for said pneumatically damped free-fall through the tube.

22. The evacuation system as defined in claim 21 further comprising a seat proximate the upper entrance end of the tube to assist a user in entering the carrier when held in said position aligned with the center axis of the evacuation tube.

23. The evacuation system as defined in claim 15 further comprising a carrier holder adapted to be located at the upper floor of the building, the carrier holder having a frame with upper and lower ends and a cavity therebetween sized to hold a stack of carriers, one of said frame ends having an opening communicating with the cavity and sized to slidably receive said stack of carriers and through which the carriers can be removed, means for biasing the stack of carriers towards said opening in said one frame end, and a resilient lip at said opening configured to normally retain the carriers in the holder against said biasing means and past which each carrier may pass as it is removed from the holder.

24. The evacuation system as defined in claim 15 in which the airlock mechanism includes (i) upper and lower valves spanning across the lower end of the evacuation tube proximately above the landing ramp, the valves being automatically and pneumatically sequentially operated free of electrical power requirements between open and closed positions to establish an airlock between the inside of the evacuation tube and the outside environment as the carrier passes therethrough, (ii) upper and lower tripper switches associated with the upper and lower valves, the upper and lower tripper switches being operative to detect the passing of a carrier through the upper and lower valves, respectively, when said valves are in said open positions, the upper and lower tripper switches being further operative to cause said upper and lower valves to close upon detection of the passing of a carrier therethrough, and (iii) first and second end-of-stroke switches operative to detect full closing of the upper and lower valves, respectively, and to cause opening of the lower and upper valves upon detection of full closing of the upper and lower valves, respectively.

25. The evacuation system as defined in claim 15 further comprising a voice tube extending from the upper floor of the building to ground level proximate the evacuation tube for non-powered communication between the upper floor and the ground.

* * * * *